US006034602A

United States Patent [19]

Quibodeaux

[11] Patent Number: 6,034,602

[45] Date of Patent: Mar. 7, 2000

[54] COMPUTER MONITOR SWITCH

[76] Inventor: Stephan Brice Quibodeaux, 9633 Hwy. 696, Abbeville, La. 70510

[21] Appl. No.: 09/149,348

[22] Filed: Sep. 8, 1998

[51] Int. Cl.[7] ..... G08B 13/19

[52] U.S. Cl. ..... 340/567; 337/1; 361/170; 361/173; 361/195

[58] Field of Search ..... 340/567; 337/1; 361/1, 170, 179, 173, 195; 395/899

[56] References Cited

U.S. PATENT DOCUMENTS

| | | | |
|---|---|---|---|
| 5,417,487 | 5/1995 | Dahnert | 312/201 |
| 5,489,891 | 2/1996 | Diong et al. | 340/567 |
| 5,489,892 | 2/1996 | Imuro et al. | 340/567 |
| 5,495,302 | 2/1996 | Abruna | 348/819 |
| 5,563,581 | 10/1996 | Kats | 340/567 |
| 5,634,846 | 6/1997 | Lee et al. | 454/256 |
| 5,673,022 | 9/1997 | Patel | 340/567 |
| 5,701,117 | 12/1997 | Platner et al. | 340/567 |

*Primary Examiner*—Glen Swann
*Attorney, Agent, or Firm*—Henderson & Sturm LLP

[57] ABSTRACT

A computer monitor system including an infrared motion detecting switch that deactivates the monitor after a predetermined delay during which no movement is detected in the vicinity of the monitor. The system is designed to prevent damage to the screens through excessive use.

5 Claims, 2 Drawing Sheets

COMPUTER MONITOR SWITCH

BACKGROUND OF THE INVENTION

1. Field of the Invention

The present invention relates to the field of electronic switches, and more particularly to an infrared computer monitor switch.

2. Description of Related Art

As can be seen by reference to the following U.S. Pat. Nos. 5,417,487; 5,489,891; 5,489,892; 5,495,302; 5,563,581; and 5,634,846, the prior art is replete with myriad and diverse electronic switching devices.

While all of the aforementioned prior art constructions are more than adequate for the basic purpose and function for which they have been specifically designed, they are uniformly deficient with respect to their failure to provide a simple, efficient, and practical automatic switch for computer monitors.

As a consequence of the foregoing situation, there has existed a longstanding need for a new and improved automatic computer monitor switch and the provision of such a construction is a stated objective of the present invention.

BRIEF SUMMARY OF THE INVENTION

Briefly stated, a computer monitor system includes an infrared motion detecting switch that deactivates the monitor after a predetermined delay during which no movement is detected in the vicinity of the monitor. The system is designed to prevent damage to the screens through excessive use.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
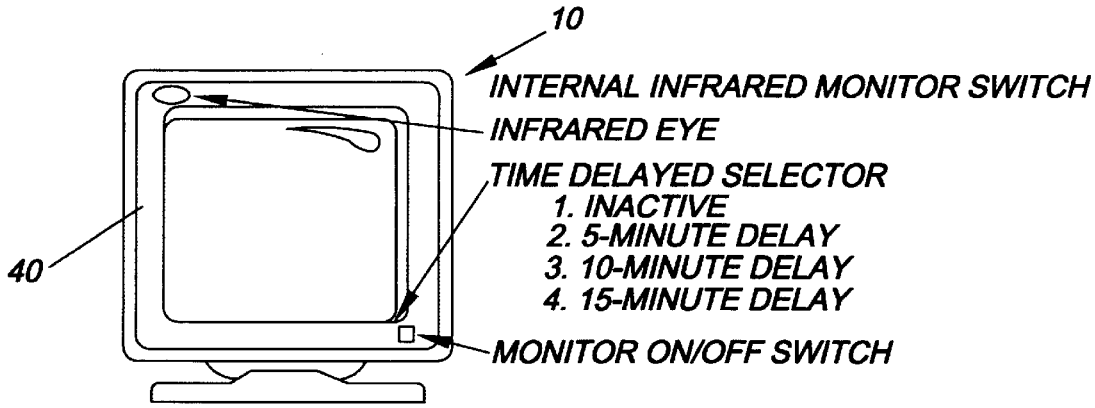
FIG. 1 is a front elevational view of a computer monitor having an internal infrared monitor switch.
Figure 2:
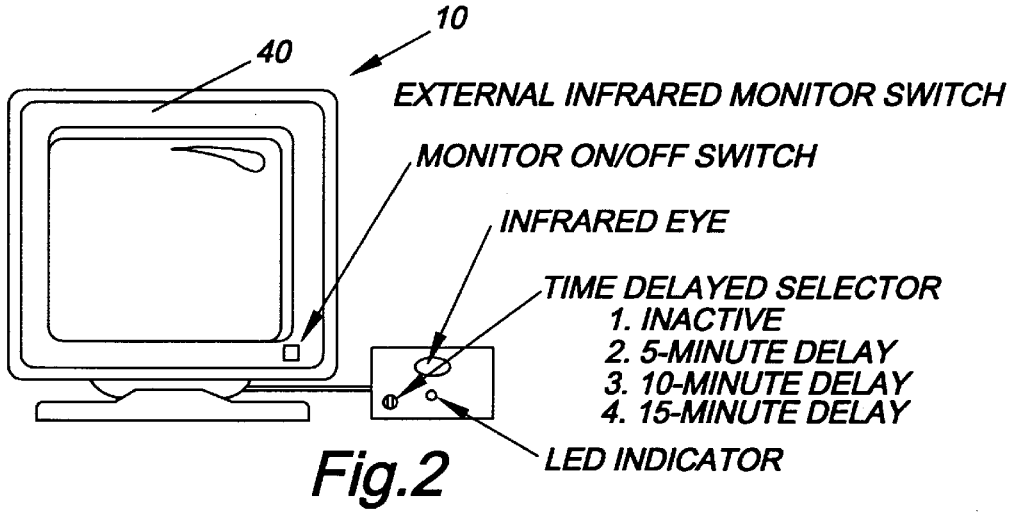
FIG. 2 is a front elevational view of a computer monitor with an external infrared monitor switch.

As can be seen by reference to the drawings, and in particularly to FIG. 1, the computer monitor switch that forms the basis of the present invention is designated generally by the reference number 10. The monitor switch 10 functions as a sensing device that automatically detects the presence of a human at the computer station and switches the monitor 40 on. When the user is absent for a set period of time, the monitor 40 shuts off, thereby saving energy.

Figure 3:
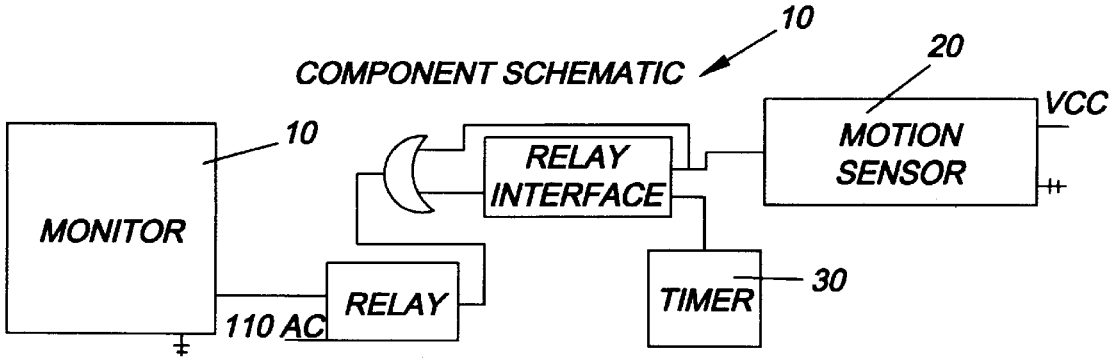
FIG. 3 is a component schematic of the computer monitor switch of the present invention.

The monitor switch 10 utilizes existing technology as found in common outdoor lighting and home security system which activate by detecting motion via an infrared sensing device. The motion sensor (FIG. 3) 20 is tied into an electronic timer 30 that can be set to various time delay positions, allowing the user to customize the delay time desired. The timer 30 automatically rests to zero each time it begins a new timing sequence, which is activated by the infrared sensor 20 detecting a lack of movement in the room. The monitor switch 10 is manufactured as an integral component of new computer monitors 40, or is sold as an accessory to allow use with any computer monitor. When used as an accessory, the computer monitor 40 is plugged into the monitor switch 10 which in turn is plugged into the power source.

In use, the user sets the timer 30 to the desired setting. Settings include "5 minute", 10 minutes", "15 minute" and "inactive". Anytime the user is in the same area as the computer, the sensor detects this, and provides power to the computer monitor 40. Anytime the user is away from the computer, and the time frame exceeds the set time delay, (5, 10, or 15 minutes), the monitor switch interrupts power to the monitor, causing it to shut down, thereby saving energy and possibly extending the service life of the monitors CRT (cathode ray tube). As soon as the user returns to the room where the computer is located, the infrared sensor 20 immediately detects this and once again provides power to the computer monitor 40. The timer 30 also has an "inactive" setting which can be selected, if desired, to disable the shut down feature altogether. Use of the monitor switch 10 provides a very cost effective method of saving energy, while as an added benefit, extending the service life of an expensive computer monitor. The monitor switch 10 can be utilized as a remote "on-off" sensor for electrical devices other than a computer monitor 40 if desired by the user.

The monitor switch 10 uses preexisting technology to conveniently control the power saving function of a computer monitor 40. The monitor switch 10 prolongs the life of monitors 40 and also saves energy for both the user, and the global economy. It gives easy access and quicker response time to the power saving function of computer monitors 40 all in a simple and easy to manufacture circuit.

The monitor switch 10 controls the power of a computer monitor 40 in a very convenient way. When the user is in the room and within working distance of the computer, the monitor 40 remains on. When there is no one within working distance of the computer, the monitor 40 shuts off. Upon reentering the work area, the monitor 40 quickly responds by returning to the on position. If the user wishes to use the computer immediately upon returning, the monitor 40 will be on, warmed up and ready to be used. The conventional power saving function for a computer monitor is often buried within an option menu, making it difficult to access. With the monitor switch 10, the controls are virtually in front of the user, conveniently located on or near the monitor's case. The monitor switch 10 also carries a lower risk factor that the conventional power saving function of monitors. In some situations, using the existing power saving function, when processing large files, the user may be interrupted by their monitor 40 going blank. Also, while using the existing power saving function, when the monitor 40 is powered down, there is greater risk of the user forgetting that the computer is on and leaving the work area for a long extended period of time. This mistake could result in costly repairs to the computer. While processing large files, if the user is within working distance of the terminal, they can be assured that the monitor 40 will remain on, also the user is less likely to forget the computer is on when the monitor 40 respond to their presence.

Figure 4:
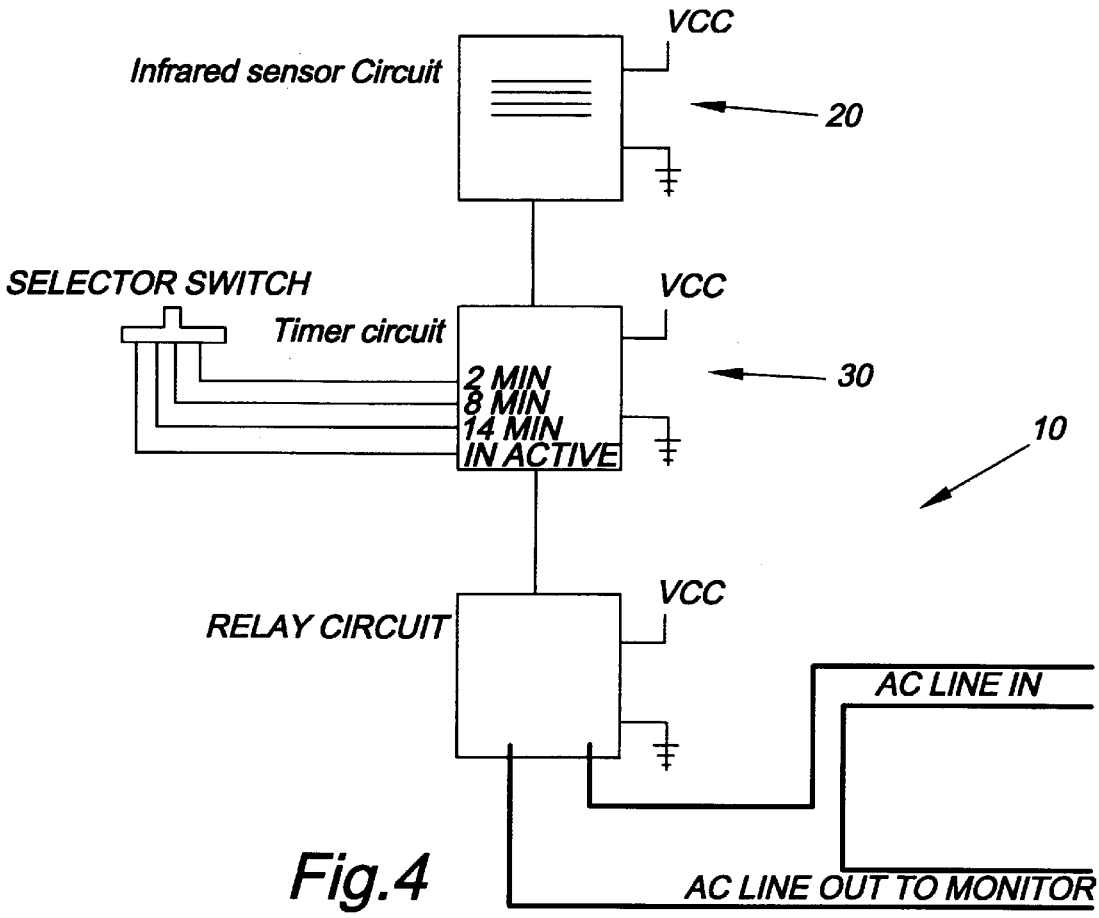
FIG. 4 is a component schematic similar to FIG. 3, but illustrating a selection switch of the timer.
Figure 5:
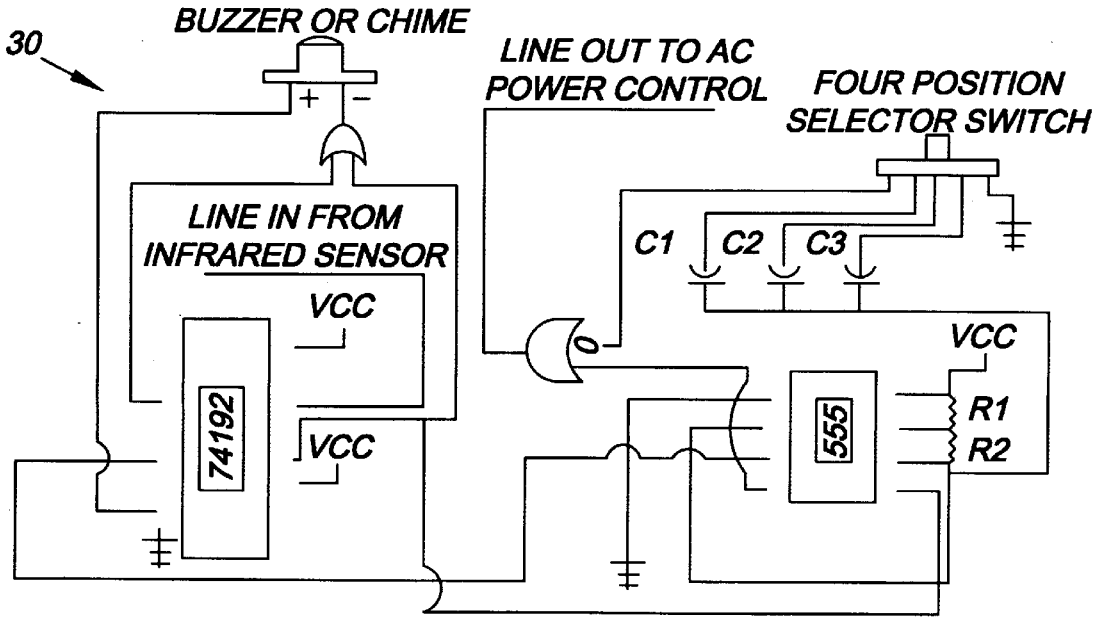
FIG. 5 is a schematic of the timer wherein C1, C2, and C3 are calculated to give the desired time delay selections; R1 and R2 are calculated to give a pulse which has a long HI and a short LOW; and the time interval for the LOW is the amount of time the buzzer/chime will sound, when active.

The monitor switch 10 achieves all of this through a very simple circuit. The primary circuit is an infrared motion detector 20 like those used in circuitry systems. The secondary circuit is a simple delay timer 30 with four settings as shown in FIG. 4. The four settings are as follows:

1=2 minute delay

2=8 minute delay

3=14 minute delay

4=INACTIVE

Upon turning the computer on, the primary circuit gives off a few short pulses—this clears the delay timer 30 and assures a fresh start. This is a natural function of most infrared motion detectors 20. During the first few seconds, the primary circuit familiarizes itself with the room. From this point on, slight body motion is detected by the primary circuit and is registered as a short pulse to the secondary circuit. This pulse clears the delay timer 30. If any motion is not detected for the selected delay time the secondary circuit then shuts the monitor 40 off. Approximately ten seconds prior to shut off, the secondary circuit will give a pleasant warning chime. After shut off, the monitor 40 will remain off until a slight body motion is detected. Infrared motion detectors can ignore motion from small mechanical objects such as oscillating fans and grandfather clocks and still be highly sensitive to small body motion such as typing.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A computer monitor switch, adapted for use with a computer monitor powered by a power source, the computer monitor switch, comprising:

an infrared motion detecting switch electrically connected to the monitor; and a timer circuit set at a predetermined time and being electrically coupled to the infrared switch, wherein failure to detect motion in the vicinity of the monitor for a predetermined time interrupts the power source and deactivates the monitor.

2. The computer monitor switch of claim 1 wherein the infrared switch is disposed within the monitor.

3. The computer monitor switch of claim 1 wherein the infrared switch is disposed externally of the monitor.

4. The computer monitor switch of claim 1 wherein the timer circuit includes a plurality of settings for the predetermined time.

5. The computer monitor switch of claim 4 wherein the timer circuit includes an audible warning signal that activates shortly before deactivation of the monitor.

* * * * *